US006416421B1

(12) United States Patent
Sery

(10) Patent No.: US 6,416,421 B1
(45) Date of Patent: Jul. 9, 2002

(54) CAP HOSEL FOR POLAR BALANCED PUTTER

(75) Inventor: Joseph Sery, San Diego, CA (US)

(73) Assignee: Carbite, Inc., San Diego, CA (US)

( * ) Notice: Subject to any disclaimer, the term of this patent is extended or adjusted under 35 U.S.C. 154(b) by 0 days.

(21) Appl. No.: 09/512,953

(22) Filed: Feb. 25, 2000

(51) Int. Cl.[7] ..... A63B 53/04; A63B 53/02

(52) U.S. Cl. ..... 473/305; 473/313; 473/340; 473/341

(58) Field of Search ..... 473/131, 324, 473/340, 341, 334, 335, 336, 337, 338, 339, 349, 305, 313, 314, 306, 307, 312, 251, 219; D21/736–746, 753

(56) References Cited

U.S. PATENT DOCUMENTS 2,530,446 A * 11/1950 Beardsley
3,042,405 A * 7/1962 Solheim
3,191,936 A * 6/1965 Guier
3,516,674 A * 6/1970 Scarborough
4,174,108 A * 11/1979 Reinholz
4,506,888 A 3/1985 Nardozzi, Jr.
4,508,350 A * 4/1985 Duclos
4,693,478 A * 9/1987 Long
4,979,744 A * 12/1990 Alcala
5,004,237 A * 4/1991 Antonious
5,078,398 A * 1/1992 Reed
5,246,231 A * 9/1993 Antonious
5,362,048 A 11/1994 Haste
5,580,058 A * 12/1996 Coughlin
5,842,935 A 12/1998 Nelson
5,938,543 A * 8/1999 McGeeney
5,951,412 A * 9/1999 Rose
6,001,024 A 12/1999 Van Alen, II et al.
6,086,484 A * 7/2000 Uebelhor
6,264,571 B1 * 7/2001 Lekavich
6,328,662 B1 * 12/2001 Huang

* cited by examiner

*Primary Examiner*—Sebastiano Passaniti
(74) *Attorney, Agent, or Firm*—John L. Gray

(57) ABSTRACT

A polar balanced putter is shown having a body made of readily castable material and having a high density material in the toe and head portions and a low density material in the center portion. Connected to the putter body by a joint bar is a hosel made from a high strength light weight material.

5 Claims, 2 Drawing Sheets

CAP HOSEL FOR POLAR BALANCED PUTTER

BACKGROUND OF THE INVENTION

Putters are currently manufactured complete with integrally cast aluminum hosels. Few aluminum alloys suitable for casting are strong enough to serve as long hosels. Alternatively, a steel body and long hosel could be used but this would reduce the possibility of having the putter with higher density at each end and lighter density in the center portion. Using this type of construction, the hosel has to be of much heavier cross section and reinforced to achieve the desired strength. This restricts the shape and affects the desired appearance of the design.

BRIEF SUMMARY OF THE INVENTION

The putter of the instant invention is made of two parts, the body has a high density material in the toe and the heel portions and a low density material in the center portions. This of course compensates for balls that are not hit squarely on the sweet spot. By making the hosel separate and then connecting it to the body of the putter directly or by means of a joint bar, it is possible to make the body from a material which is readily castable. This permits the use of light weight yet high yield strength material and thus maintains the maximum design with the heel and the toe being denser than the center. Not only can the putter, according to the present invention, have a hosel manufactured from a light weight yet high strength material, but this can be achieved without the use of a post assembly heat treatment process. By means of this invention, it is possible to combine a body which is manufactured using a lightweight material which is most suitable for the casting process with a hosel which is manufactured using another lightweight material having a high strength but is not readily castable. The body of the putter is still manufactured by using very high density material placed in the toe and heel portions of a mold and the center portion is constructed of light weight material. This low density material secures the heavy toe and heel in position by both mechanical and diffusion bonding means.

It is therefore an object of this invention to provide a putter which will have a combination of a readily castable light-weight body portion connected to a hosel or to a hosel through a joint bar of material which is not necessarily readily castable.

This, together with other objects of the invention, will become apparent from the following detailed description of the invention and the accompanying drawings.

DETAILED DESCRIPTION OF THE INVENTION

Figure 1:
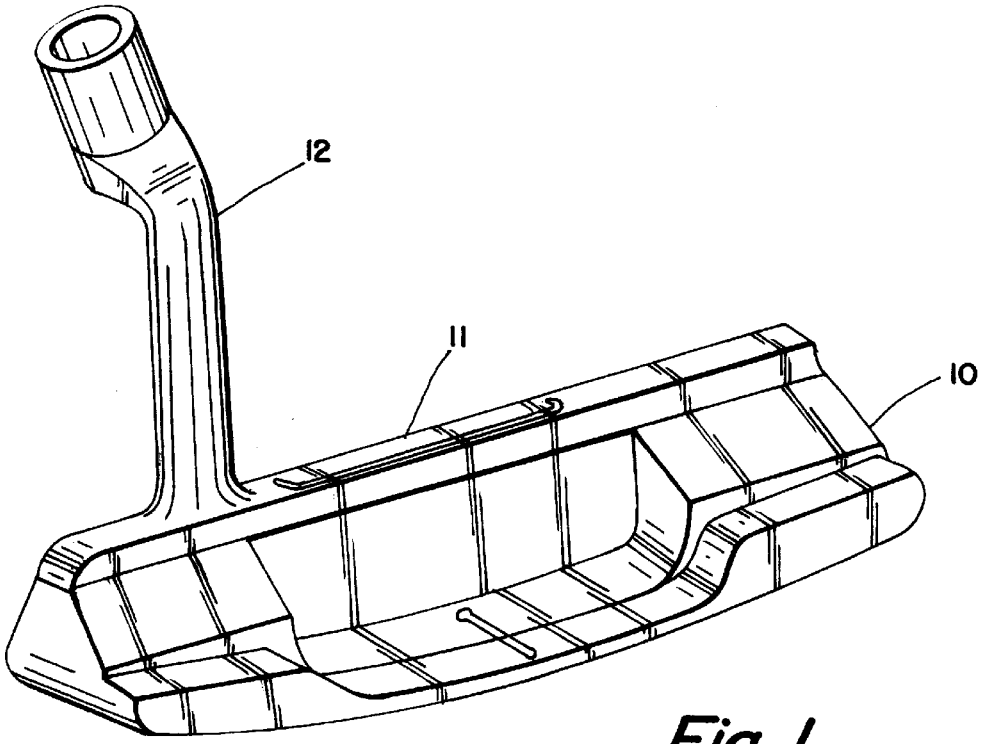
FIG. 1 is a perspective view of a putter made in accordance with the invention in assembled form.

Referring now to FIG. 1, a putter body 10, which is preferably a polar balanced putter, is attached to a joint bar 11 which is an integral part of a hosel 12. The attachment may be made by welding, brazing, diffusion, adhesive bonding, mechanical fasteners or other suitable means.

By making the body 10 separate, it is possible to cast the body 10 in a mold with the toe and heel portions of the putter containing a very high density material and the center portion filled with a lightweight material. The low density material secures the heavy toe and heel in position by both mechanical and diffusion bonding means. The material preferably used for the center portion of the putter is most suitable for the high pressure or squeeze casting process, i.e., type 356 aluminum. The putter hosel 12 and the joint bar 11 can be manufactured from a high strength forged and/or heat treated lightweight material. Suitable materials include aluminum alloys such as types 7075, 2014, and 2024. The component consisting of 11 and 12 can be a shell casting, forging or fully machined and then further heat treated to achieve the desired condition.

Figure 2:
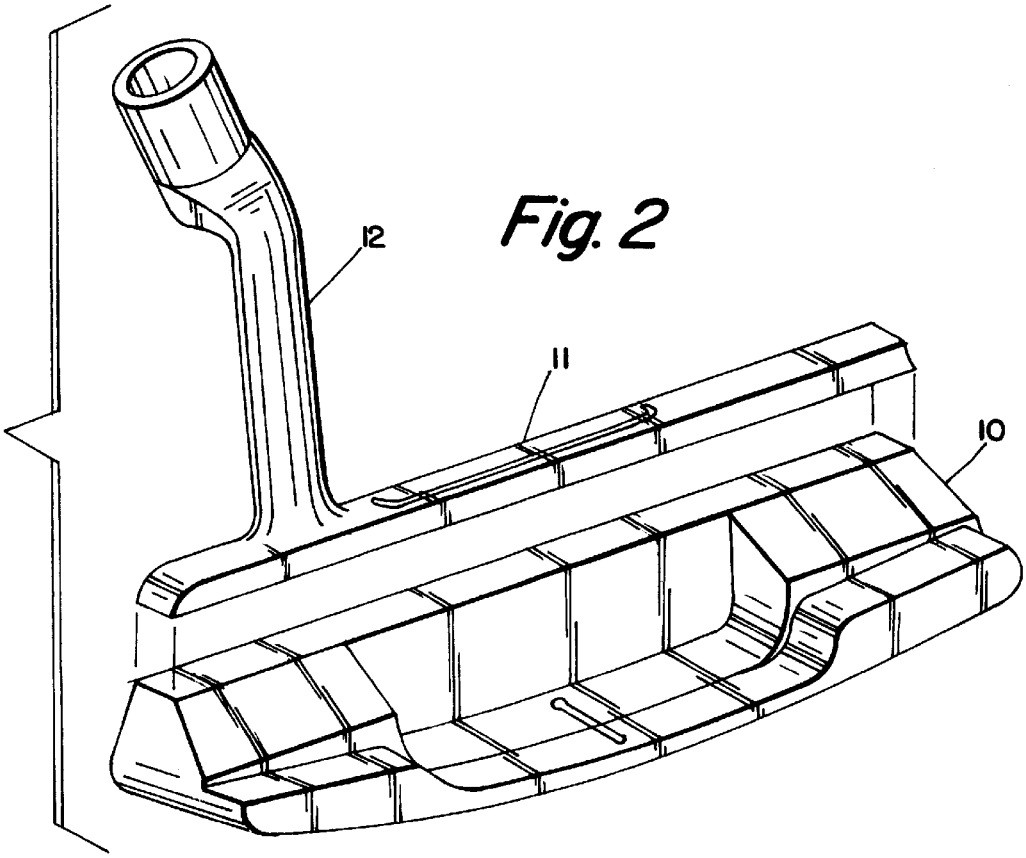
FIG. 2 is a perspective view of a putter with the hosel and joint bar disassembled from the putter body.
Figure 3:
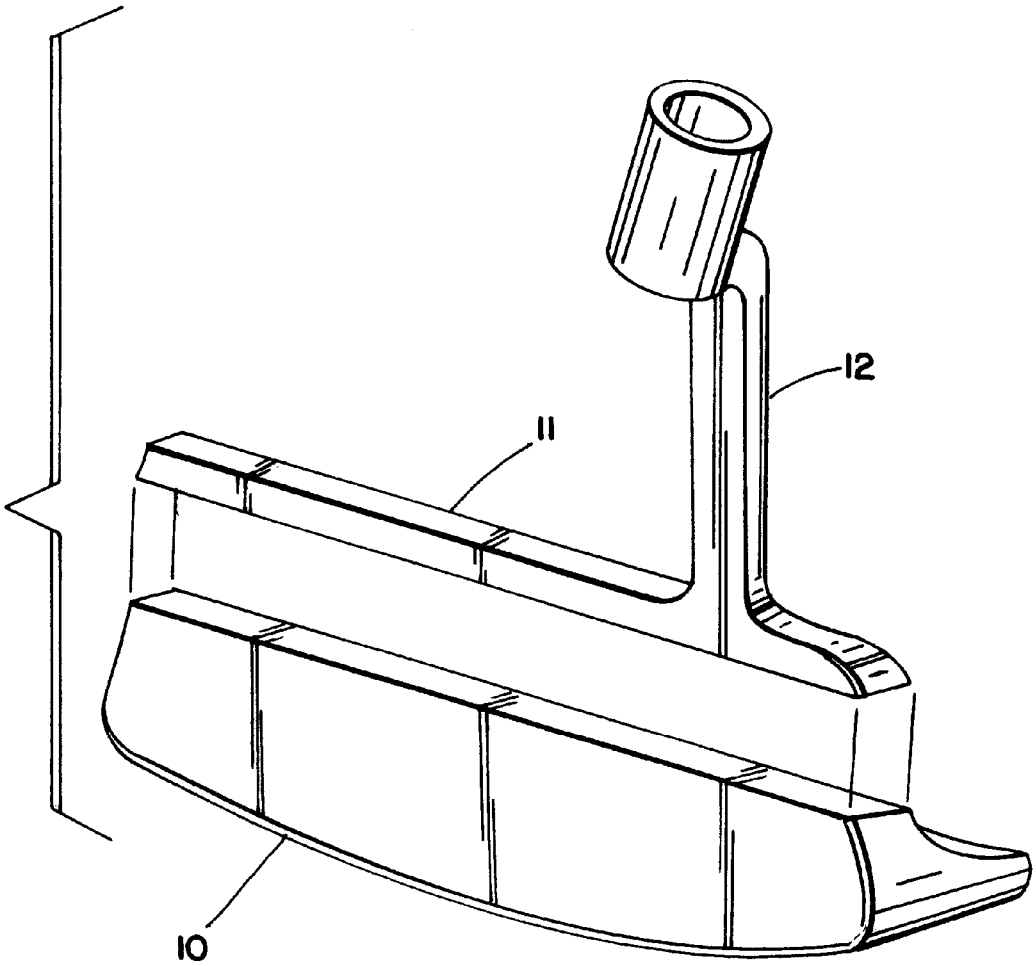
FIG. 3 is a rearview of FIG. 2.

FIGS. 2 and 3 merely show a different view of the putter with the body 10 disassembled from the joint bar 11 and the hosel 12.

While this invention has been shown and described with respect to a detailed embodiment thereof, it will be understood by those skilled in the art that various changes in form and detail thereof may be made without departing from the scope of the claims of the invention.

What is claimed is:

1. A polar balanced putter provided with toe, heel and center portions and comprising a putter body having a high density material forming the toe and heel portions and a low density material forming the center portion, a hosel made from a material having higher strength than said putter body, said hosel being connected to said putter body by means of a joint bar.

2. The polar balanced putter of claim 1 wherein said joint bar is connected to said putter body by welding, brazing, diffusion bonding, or adhesive bonding.

3. The polar balanced putter of claim 1 wherein said body is made from a material which may be cast.

4. The polar balanced putter of claim 1 wherein said hosel and joint bar are made from high strength material that may not be cast.

5. The polar balanced putter of claim 1 wherein said body is made from material which may be cast and said joint bar and hosel are made from a material which may not be cast.

* * * * *